US006877465B1

(12) United States Patent
Pierik

(10) Patent No.: US 6,877,465 B1
(45) Date of Patent: Apr. 12, 2005

(54) METHOD AND APPARATUS FOR ADJUSTING THE ANGULAR POSITION OF A COLLAR ON A SHAFT

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/741,796

(22) Filed: Dec. 19, 2003

(51) Int. Cl.[7] ..... F01L 1/34

(52) U.S. Cl. ..... 123/90.16; 123/90.15; 403/373

(58) Field of Search ..... 123/90.16, 90.15; 403/109.5, 109.6, 373, 374.1, 374.2, 376–378, 409.1, 324

(56) References Cited

U.S. PATENT DOCUMENTS 6,736,096 B2 * 5/2004 Pierik ..... 123/90.16

* cited by examiner

*Primary Examiner*—Thomas Denion
*Assistant Examiner*—Zelalem Eshete
(74) *Attorney, Agent, or Firm*—Patrick M. Griffin

(57) ABSTRACT

A control arm clamp and shaft assembly for fine adjustment of angular position of the clamp on the shaft. An adjustment bolt and nut includes a socket head located eccentrically relative to the centerline of the bolt shaft so that the bolt head can function as a cam lobe when the bolt is turned. The control arm clamp includes a primary shaft clamping means. The shaft has a diametric bore. The control arm clamp has an axially-slotted opening into which the bolt head fits and engages opposing walls of the opening. When the primary clamping means is loosened, rotation of the adjustment bolt head against the opening wall causes an angular rotation of the control arm relative to the shaft. After the control arm is repositioned, the primary clamp is retightened and the adjustment bolt nut is tightened. The adjustment bolt may also take the form of a removable pin.

10 Claims, 4 Drawing Sheets

METHOD AND APPARATUS FOR ADJUSTING THE ANGULAR POSITION OF A COLLAR ON A SHAFT

TECHNICAL FIELD

The present invention relates to a means for adjusting the angular position of a collar on a shaft; more particularly, to means for adjusting and securing a variable valve actuator (VVA) control shaft arm to a rotatable control shaft; and most particularly, to such means wherein very small, predictable adjustments may be made of the angular relationship of the arm to the shaft without displacing the arm axially.

BACKGROUND OF THE INVENTION

Variable valve actuation mechanisms for altering the valve timing of internal combustion engines are well known. One such known approach relies on a control shaft arm clamp to position and lock the control shaft arm in place in order to set valve lift timing. Present clamp designs cannot meet more stringent engine manufacturing requirements for fine adjustment of the relative rotary position of the control arm on the control shaft so that air flow to each cylinder is the same. Further, there must be assurance that, after being positioned correctly, the control arm cannot slip around the control shaft, which could cause imprecise valve lift timing and possible engine damage.

The control arm position is used to calibrate the VVA mechanism so that the airflow to each engine cylinder is the same. A prior art adjustment method requires the clamp to be loosened so that it can be angularly repositioned about the control shaft. After repositioning, the clamp screw is retightened. A problem with this method is that, once loosened, the clamp moves freely, both axially and tangentially around the control shaft. An operator making the adjustment can have great difficulty in making a very small angular adjustment while maintaining accurate axial position. Even if the axial position were not a problem, it is quite difficult for an operator to precisely and repeatably make a very small angular adjustment, for example, 0.1 degree, to the control arm clamp.

What is needed is an improved clamp whereby very small and predictable angular adjustments may be made while maintaining invariant axial position.

What is further needed is redundant means in an improved clamp so that, if the clamp should come loose or is not properly tightened, the axial and angular position of the clamp with respect to the control shaft cannot change significantly.

It is a principal object of the present invention to permit fine adjustment of angular position of a clamp on a shaft.

It is a further object of the invention to provide such adjustment without causing or allowing axial movement of the clamp on the shaft.

It is a still further object of the invention to provide such adjustment which is then redundantly locked into the mechanism.

SUMMARY OF THE INVENTION

Briefly described, a control arm clamp and control shaft assembly in accordance with the invention for fine adjustment of angular position of the clamp on the shaft uses a special adjustment bolt and nut wherein the head of the bolt is located eccentrically relative to the centerline of the bolt shaft. Thus the bolt head can function as a cam lobe when the bolt is turned. The control arm clamp includes a conventional gap in the shaft-surrounding element and a conventional tangential bolt for compressing the clamp onto the shaft, defining a primary clamping means. The shaft has a diametric bore in which the adjustment bolt is close-fitting but rotatable. The control arm clamp has a first axially-slotted opening on one side of the shaft into which the bolt head fits and engages a side of the opening. The control arm clamp has a second circumferentially-slotted opening diametrically opposed to the first opening. Once the adjustment bolt is installed through the clamp and shaft, the primary clamping bolt can be loosened so that the clamp and control arm may be moved about the shaft. Rotation of the adjustment bolt head in the first opening causes a small angular rotation of the control arm relative to the shaft. After the control arm is repositioned, the primary clamping bolt is retightened and the adjustment bolt nut is also tightened. The adjustment bolt and primary clamping bolt are redundant: Even if the primary clamping bolt is not tightened or is even removed but the adjustment bolt remains installed, the control arm clamp cannot move more than the designed adjustment range and almost no axial distance because of the adjustment bolt. As an alternate configuration, the adjustment bolt may instead be in the form of a removable adjustment pin.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
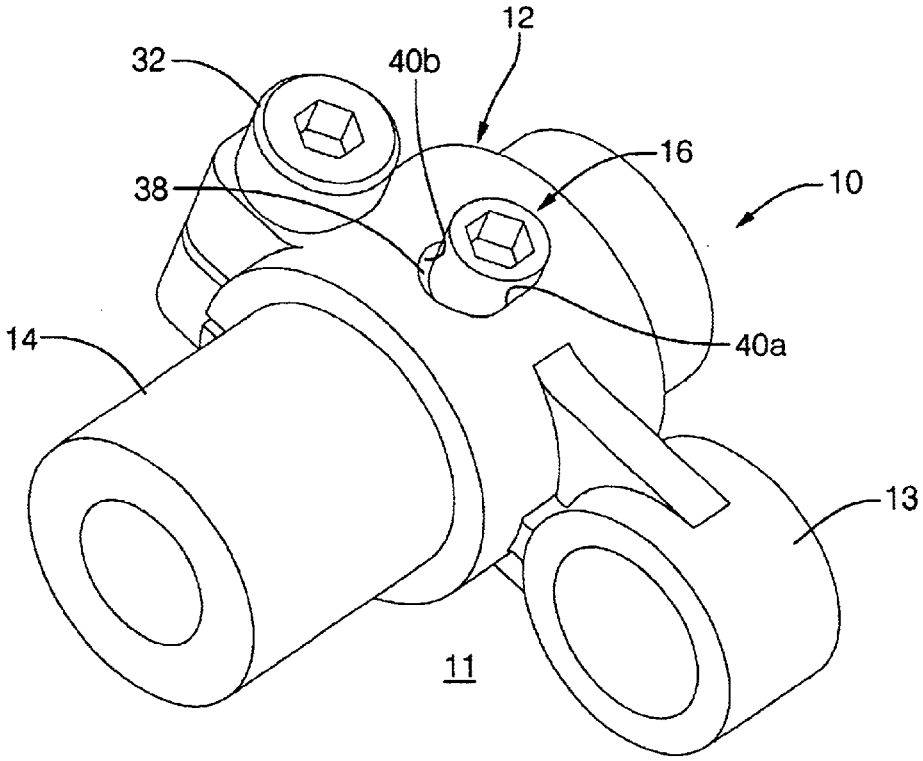
FIG. 1 is an isometric view from above of an improved control arm clamp and control shaft assembly in accordance with the invention.
Figure 2:
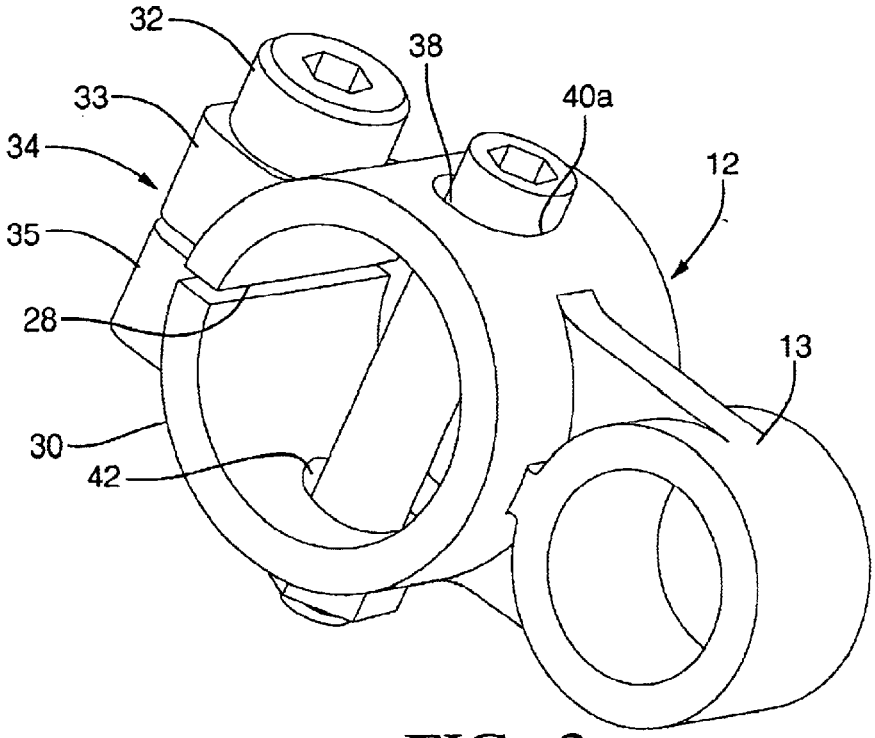
FIG. 2 is an isometric view of just the clamp and adjustment bolt shown in FIG. 1.

Various variable valve mechanisms are well known, as for example, the mechanism disclosed in incorporated reference U.S. Pat. No. 6,019,076. In such a mechanism, a control arm coupled to a control shaft is used to set the point at which a corresponding engine valve begins to open through its actuation cycle. This set point is made by angularly positioning the control arm on the shaft and locking the arm in place by a clamp and bolt arrangement.

Referring now to FIGS. 1 through 6 herein, assembly 10 in accordance with the invention for use with a typical variable valve actuation mechanism in an internal combustion engine is shown. Engine 11 includes a control arm clamp 12 and control arm 13, a modified control shaft 14, and a special adjustment bolt 16 and nut 18. Bolt 16 (FIG. 3) includes eccentric 20 having an axis 22 offset from the axis 24 of bolt shaft 25. In a currently preferred embodiment, eccentric 20 is a socket head 26 that can function as a cam lobe when the bolt is turned. Control arm clamp 12 (FIGS. 2 and 5) includes a conventional gap 28 in the shaft-surrounding collar 30 and a conventional tangential screw 32 cooperating with first and second tangs 33,35 for compressing collar 30 onto control shaft 14, defining a primary shaft-clamping means 34. Shaft 14 has a diametric bore 36, at the desired axial clamping position of control arm clamp 12, in which shaft 25 of adjustment bolt 16 is close-fitting but rotatable. Control arm clamp 12 has a first axially-slotted opening 38 into which bolt head 26 fits and engage sides 40*a* and 40*b* of the opening. Control arm clamp 12 has a second circumferentially-slotted opening 42 diametrically opposed to the first opening in which distal end 27 of shaft 25 fits and engages sides 43*a* and 43*b* of second opening 42.

After adjustment bolt 16 is installed through clamp 12 and shaft 14 via openings 38,42 and bore 36, eccentric bolt head 26 is disposed in slotted opening 38, and end 27 is disposed in slotted opening 42, primary clamping means 34 may be loosened so that clamp 12 may be moved angularly about the shaft for fine positioning of the control arm 13. Because of the eccentric relationship of bolt head 26 to bolt shaft 25, rotation of adjustment bolt head 26 in first opening 38 causes a small angular rotation of control arm 13 relative to shaft 14 as eccentric 20 sweeps through its arc and engages sides 40*a* and 40*b* of opening 38. Because of a close fit between end 27 of shaft 25 and sides 43*a* and 43*b* of opening 42, unnecessary axial movement of control arm 13 parallel to the axis of control shaft 14 is minimized.

After control arm 13 is repositioned to a desired angle with respect to control shaft 14 in this manner, primary clamping means 34 is retightened and adjustment bolt nut 18 is also tightened. As noted above, the adjustment bolt and primary clamping means are redundant: Even if primary clamping screw 32 is not tightened or is even removed but adjustment bolt 16 remains installed, control arm clamp 12 cannot move more than the designed angular adjustment range and almost no axial distance because of the relationship conferred by adjustment bolt head 26 in first opening 38 and end 27 in second opening 42.

As an alternate configuration of adjustment bolt 16, threaded portion 44 can be limited in length so that, after the position of control arm 13 is set and primary clamping means 34 is retightened, tightening of nut 18 onto threaded portion 44 does not exert any additional clamping force on the control shaft. Even without this secondary clamping force, retention redundancy of control arm 13 will be maintained because of the close-fitting relationships between the adjustment bolt 16 and first and second openings 38 and 42.

These embodiments permit fine adjustment of angular position of a damp on a shaft; provides means for such adjustment without causing or allowing axial movement of the clamp on the shaft; and redundantly locks an adjusted clamp to a control shaft.

Figure 3A:
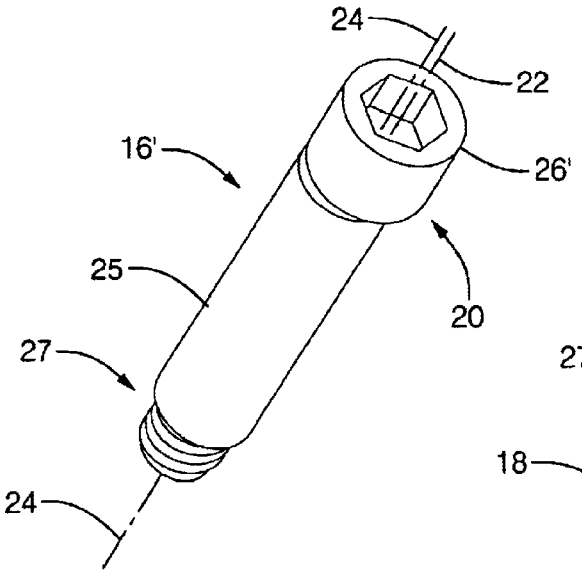
FIG. 3*a* is an isometric view of an alternate embodiment adjustment pin.
Figure 3:
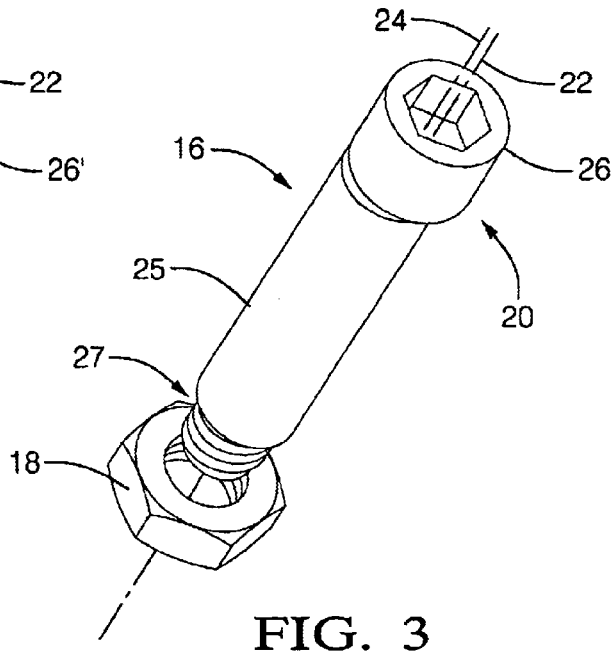
FIG. 3 is an isometric view of the adjustment bolt shown in FIGS. 1 and 2.
Figure 4:
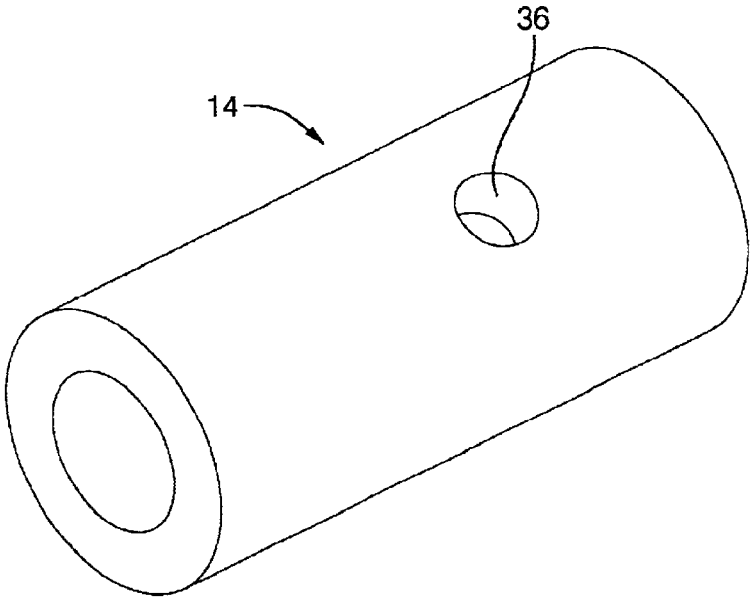
FIG. 4 is an isometric view of the control shaft shown in FIG. 1.
Figure 3B:
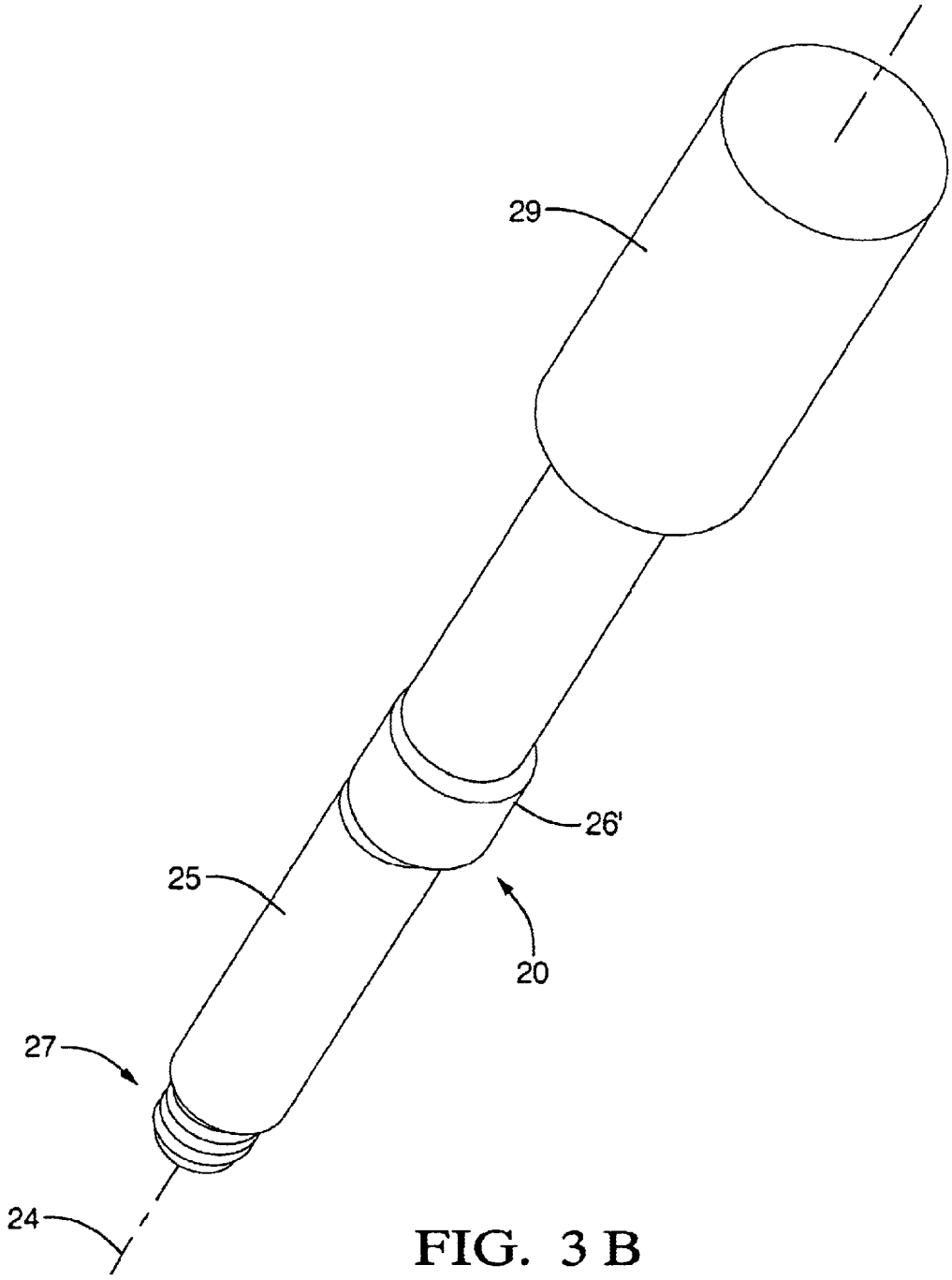
FIG. 3*b* is an isometric view of the adjustment pin shown in FIG. 3*a* having a grip end.
Figure 5:
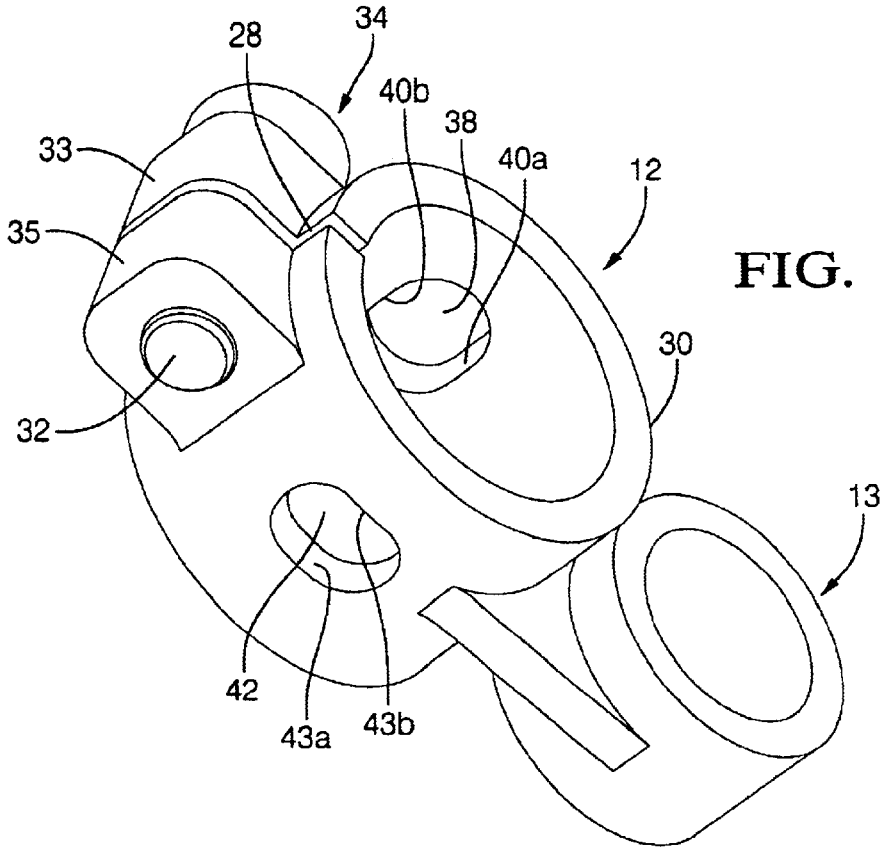
FIG. 5 is an isometric view from below of the clamp shown in FIG. 2.
Figure 6:
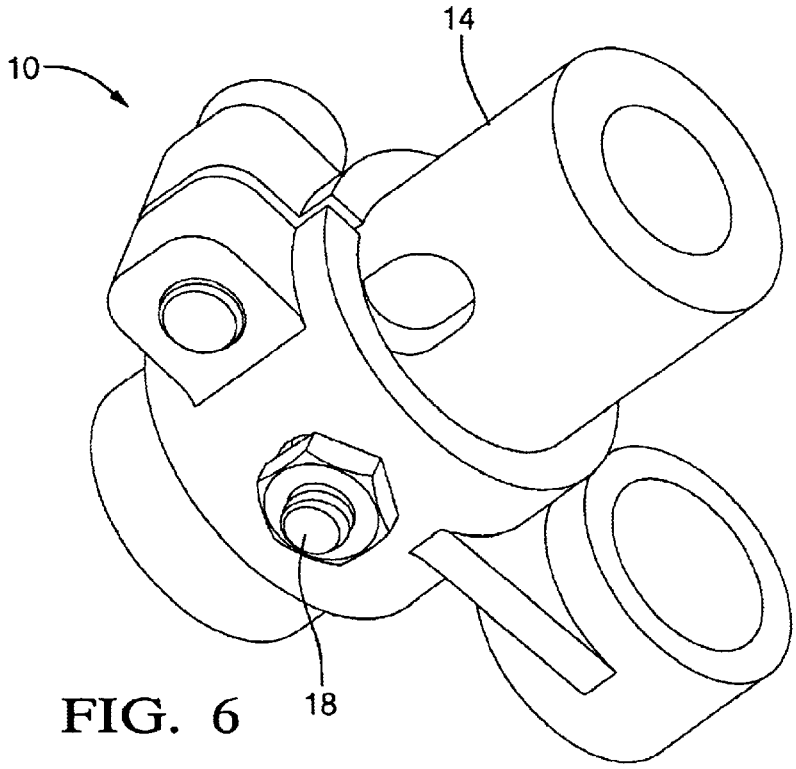
FIG. 6 is an isometric view from below of the assembly shown in FIG. 1.

As a further embodiment contemplated by this invention, threaded adjustment bolt 16 can be replaced by a removable pin similar in eccentric construction to bolt 16. Eccentric pin 16' (FIG. 3*a*) includes eccentric 20 having an axis 22 offset from the axis 24 of shaft 25. However, unlike bolt 16, adjustment pin 16' is unthreaded. Head 26' is preferably formed to receive a driving tool, may be formed with a grip 29 so that it can be used much like a screw driver (FIG. 3*b*) or can be a received in a power driver chuck so that a mechanized adjustment can be made on an assembly line. Similar to bolt 16, the eccentric construction of pin 16' functions as a cam lobe when the pin is turned.

In this embodiment (FIGS. 3*a* and 3*b*), with primary clamping means 34 loosened so that clamp 12 is loose on control shaft 14, adjustment pin 16' is installed through clamp 12 and shaft 14 via openings 38,42 and bore 36, eccentric 20 is disposed in slotted opening 38, and end 27 is disposed in slotted opening 42. Precise angular positioning of control arm 13 on shaft 14 is then made by rotating adjustment pin 16'. Once positioning of control arm 13 relative to shaft 14 is completed, primary clamping means is tightened and adjustment pin 16' is removed.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system for making and securing fine adjustment of angular position of a clamp on a shaft, comprising:

a) a shaft having a transverse bore;

b) a clamp formed as a collar for encircling said shaft, said collar having a means for compressing said collar against said shaft to secure said clamp to said shaft, said collar having an axially slotted first opening proximal to said shaft bore; and c) an adjustment pin disposed in said shaft bore through said first opening and having an eccentric for engaging a wall of said first opening to cause a change in said angular position of said clamp on said shaft when said adjustment pin is rotated.

2. A system in accordance with claim 1 wherein said eccentric includes an eccentric head.

3. A system in accordance with claim 1 wherein said bore extends through said shaft, said collar includes a second opening opposite said first opening, and said pin includes a threaded portion extending through said bore and said second opening for receiving a retaining nut.

4. A system in accordance with claim 1 wherein said clamp is a control arm clamp for a variable valve actuation device and said shaft is a control shaft for said variable valve actuation device.

5. A system in accordance with claim 4 wherein said variable valve actuation device is a component of an internal combustion engine.

6. A system for making and securing fine adjustment of angular position of a control-arm clamp on a control shaft in a variable valve actuation device, comprising:

a) a shaft having a transverse bore;

b) a clamp formed as a collar for encircling said shaft, said collar having means for compressing said collar against said shaft to secure said clamp to said shaft, said collar having an axially slotted first opening proximal to said shaft bore; and c) an adjustment pin disposed in said shaft bore through said first opening and having eccentric for engaging a wall of said first opening to cause a change in said angular position of said clamp on said shaft when said adjustment pin is rotated.

7. An internal combustion engine comprising a system for variable activation of one or more engine valves, said system including a shaft having a transverse bore, a clamp formed as a collar for encircling said shaft, said collar having means for compressing said clamp against said shaft to secure said clamp to said shaft, said collar having an axially slotted first opening proximal to said shaft bore, and an adjustment pin disposed in said shaft bore through said first opening and having eccentric means for engaging a wall of said first opening to cause a change in said angular position of said clamp on said shaft when said adjustment pin is rotated.

8. A system for making and securing fine adjustment of angular position of a collar on a shaft, comprising:

a) a shaft having a transverse bore;

b) a collar encircling said shaft, said collar having an axially slotted first opening proximal to said shaft bore; and c) an adjustment pin disposed in said shaft bore through said first opening and having an eccentric for engaging a wall of said first opening to cause a change in said angular position of said collar on said shaft when said adjustment pin is rotated.

9. A system in accordance with claim 8 wherein said bore extends through said shaft, said collar includes a second opening opposite said first opening, and said pin includes a threaded portion extending through said bore and said second opening for receiving a retaining nut.

10. A method for making an adjustment of angular position of a collar on a shaft, comprising:

a) securing a shaft having a transverse bore;

b) encircling a collar around said shaft, said collar having an axially slotted first opening proximal to said shaft bore;

c) inserting an adjustment pin in said shaft bore through said first opening, said pin having an eccentric for engaging a wall of said first opening to cause a change in said angular position of said collar on said shaft when said adjustment pin is rotated; and d) rotating said adjustment pin to change said angular position of the collar on the shaft.

* * * * *